US006591792B2

(12) United States Patent
Nemoto et al.

(10) Patent No.: US 6,591,792 B2
(45) **Date of Patent: *Jul. 15, 2003**

(54) TWO-CYCLE ENGINE

(75) Inventors: Toshihisa Nemoto, Tougane (JP); Terutaka Yasuda, Tougane (JP)

(73) Assignee: Maruyama Mfg. Co., Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/813,505

(22) Filed: Mar. 20, 2001

(65) Prior Publication Data

US 2001/0045192 A1 Nov. 29, 2001

Related U.S. Application Data

(63) Continuation-in-part of application No. 09/697,011, filed on Oct. 25, 2000, now abandoned, and a continuation-in-part of application No. 09/697,012, filed on Oct. 25, 2000, now abandoned.

(30) Foreign Application Priority Data

Nov. 12, 1999 (JP) ..... 11-322993
Nov. 19, 1999 (JP) ..... 11-329833

(51) Int. Cl.[7] ..... F02B 25/18

(52) U.S. Cl. ..... 123/73 PP; 123/73 A; 123/73 C; 123/65 P; 123/182.1

(58) Field of Search ..... 123/73 AF, 73, 123/65, 74, 73 A, 73 B, 74 AP, 182.1

(56) References Cited

U.S. PATENT DOCUMENTS 3,980,064 A * 9/1976 Ariga et al. ..... 123/457
4,253,433 A * 3/1981 Blair ..... 123/73 R
4,286,553 A * 9/1981 Baltz et al. ..... 123/179.11
4,481,911 A * 11/1984 Sheaffer et al. ..... 123/73 R
4,522,170 A * 6/1985 Lenk et al. ..... 123/198 DC
4,619,228 A * 10/1986 Liu ..... 123/182.1
4,638,770 A * 1/1987 Fox ..... 123/65 P
4,779,581 A * 10/1988 Maier ..... 123/73 A
4,829,940 A * 5/1989 Okazaki et al. ..... 123/41.39
5,027,758 A * 7/1991 Siegler ..... 123/73 AD
5,090,363 A * 2/1992 Duret ..... 123/73 PP
5,503,119 A * 4/1996 Glover ..... 123/73 B
5,628,295 A * 5/1997 Todero et al. ..... 123/568.13
5,685,273 A * 11/1997 Johnson et al. ..... 123/446
5,809,949 A * 9/1998 Duret ..... 123/65 VB
5,924,400 A * 7/1999 Kobayashi ..... 123/196 R
5,992,358 A * 11/1999 Otome ..... 123/65 P
6,223,705 B1 * 5/2001 Sato et al. ..... 723/73 PP
6,289,856 B1 * 9/2001 Noguchi ..... 123/73 PP
6,367,431 B1 * 4/2002 Nemoto et al. ..... 123/65 P
6,367,432 B1 * 4/2002 Araki ..... 123/73 R
6,415,750 B2 * 7/2002 Rosskamp et al. ..... 123/73 PP
6,418,891 B2 * 7/2002 Kobayashi ..... 9/813

FOREIGN PATENT DOCUMENTS

JP 59185820 A * 10/1984 ..... F02B/17/00

* cited by examiner

*Primary Examiner*—Henry C. Yuen
*Assistant Examiner*—Rebecca A Smith
(74) *Attorney, Agent, or Firm*—Perkins Coie LLP

(57) ABSTRACT

Apparatuses and methods for reducing hydrocarbons in two-stroke engine exhaust. When a piston is close to top dead center, a groove in the lower end region of the piston confronts an exhaust port and first scavenging ports, respectively, and exhaust gas from the exhaust port is directed to the first scavenging ports. During a scavenging stroke, the first scavenging ports open first to a combustion chamber and exhaust gas is introduced to the combustion chamber, and a second pair of scavenging ports then opens to the combustion chamber and introduces a fuel-containing gas to the combustion chamber. When crankcase pressure reaches 142 Pa or higher, a relief valve opens and maintains the maximum pressure at 142 kPa or lower. Thus, blending in the combustion chamber of the exhaust gas from the first scavenging ports and the fuel-containing gas from the second scavenging ports is suppressed, and short-circuiting of the fuel component to the exhaust port is suppressed.

30 Claims, 5 Drawing Sheets

TWO-CYCLE ENGINE

RELATED APPLICATIONS

This application is a continuation-in-part application of, and claims priority from, copending U.S. patent application Ser. No. 09/697,011, filed on Oct. 25, 2000 now abandoned, which claims priority from the Japanese Patent Application No. H11-329833, filed on Nov. 12, 1999, both of which are incorporated herein by reference.

This application is also a continuation-in-part application of, and claims priority from, copending U.S. patent application Ser. No. 09/697,012, filed on Oct. 25, 2000 now abandoned, which claims priority from the Japanese Patent Application No. H11-329833, filed on Nov. 19, 1999, both of which are incorporated herein by reference.

This application is related to the copending U.S. patent application TWO-CYCLE ENGINE filed concurrently herewith and assigned to a common assignee, which is incorporated herein by reference.

TECHNICAL FIELD

The present invention concerns a 2-cycle engine furnished in an outdoor trimmer, backpack-type power spreader, or other such device, and the present invention specifically concerns a 2-cycle engine effecting a reduction in total hydrocarbons (THCs).

BACKGROUND OF THE INVENTION

In a 2-cycle engine furnished in an outdoor trimmer, backpack-type power spreader, or other such devices, a fuel-containing gas consisting of fuel and air within a crankcase is introduced from a scavenging port into a combustion chamber during a scavenging stroke, scavenging of the combustion chamber continues, and the combustion chamber becomes filled. The objective of conventional 2-cycle engine design has been to increase crankcase pressure as much as possible in order to complete scavenging in a short time.

In a conventional 2-cycle engine, the fuel-containing gas introduced from the scavenging port into the combustion chamber does not stop in the combustion chamber; short-circuiting occurs wherein this gas escapes without modification into an exhaust port, and the fuel component within the short-circuited fuel-containing gas is released together with exhaust gases into the atmosphere and becomes a source of atmospheric pollution.

SUMMARY OF THE INVENTION

An object of the present invention is to offer a 2-cycle engine able to reduce effectively the fuel component in a short-circuited gas. When the fuel density in the fuel-containing gas itself is minimized, the fuel component introduced to the exhaust system as a short-circuited gas is reduced, but the fuel density in the fuel-containing gas remaining in the combustion chamber is also reduced, and the power output of the 2-cycle engine declines. To surmount this problem, a scheme has been devised wherein the pressure in the crankcase is set to 142 kPa or lower and a gas B with a low fuel density is introduced into the combustion chamber first, a gas A with a high fuel density is introduced into the combustion chamber subsequently, and the gas remaining in the combustion chamber is primarily A, and the gas short-circuited to the exhaust port is primarily B. However, when gases A and B mix in the combustion chamber, the effect of introducing gases A and B into the combustion chamber separately declines.

DETAILED DESCRIPTION

Figure 1:
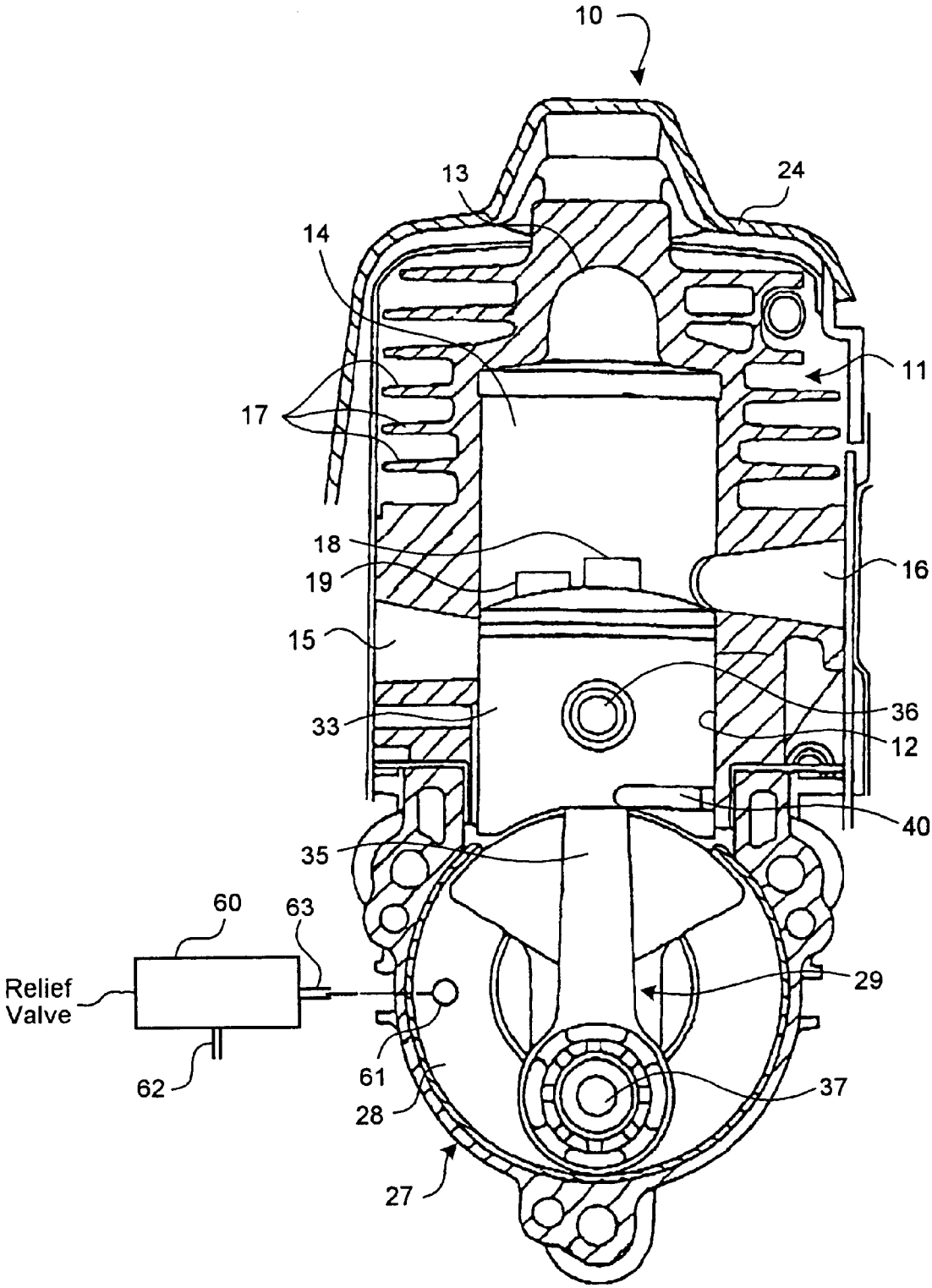
FIG. 1 is a vertical cross-sectional drawing of a Schneurle-type 2-cycle engine 10.

With reference to FIG. 1, in the 2-cycle engine 10 pertaining to the present invention, a reciprocating piston 23 within a cylinder 11 controls the periods of opening to the cylinder 11 of an intake port 15, scavenging ports 18, 19, and an exhaust port 16; a combustion chamber 14 and crankcase 28 are provided respectively on either side of the piston 23 and the reciprocation of the piston 23 increases and decreases their volume; a fuel-containing gas is introduced from the intake port 15 to the crankcase 28; the fuel-containing gas within the crankcase 28 is introduced from the scavenging ports 18, 19 to the combustion chamber 14 along the scavenging path; and the gas generated by combustion of the fuel component of the fuel-containing gas within the combustion chamber 14 is exhausted from the exhaust port 16 as an exhaust gas. In this 2-cycle engine 10, gases with high and low fuel densities are established as gas A and gas B respectively. When gas A and gas B are introduced from the scavenging ports 18, 19 to the combustion chamber 14, gas B is introduced in advance of gas A, or gas B is introduced to the combustion chamber 14 from a position closer than gas A to the exhaust port 16, short-circuited gas is thereby made to comprise primarily gas B, and the maximum value Pm of the pressure P in the crankcase 28 is thereby set to at least approximately 142 kPa or lower, 1 kPa being equal to 1000 Pa.

The fuel density G of a gas is defined as $G=G1/(G1+G2)$, where fuel weight is defined as G1 and the weight of the gas containing that fuel is defined as G2. The 2-cycle engine 10 pertaining to the present invention includes in particular a Schneurle-type 2-cycle engine. A Schneurle-type 2-cycle engine, also termed a smash-reverse-type, is a 2-cycle engine in which gas streams introduced into the combustion chamber 14 from a pair of scavenging ports provided symmetrically to the combustion chamber 14 cross-section collide with each other and form a reversing eddy. The total number of scavenging ports in a single cylinder 11 is preferably an even number (including an even number in the case of a plurality of pairs), but it may be an odd number as well as 1.

Gas B includes a gas wherein the amount of the fuel component included is zero. Gas A is, for example, one wherein a gas introduced from a carburetor into the crankcase 28 via the intake port 15 during the intake stroke (this gas is termed "gas C" hereinafter) is directed to scavenging ports 19, but it need not be gas C itself. For example, gas A may be one in which an exhaust gas, external gas (i.e., air) or inert gas (e.g., nitrogen, neon, or helium) is blended with gas C appropriately (provided that the fuel density is greater than that of gas B) in order to reduce hydrocarbons in the exhaust gas. If Pm, the maximum pressure P in the crankcase 28, is too low, the introduction of gas from the crankcase 28 to the combustion chamber 14 will be impeded. The lower limit of Pm is preferably 132 kPa or more.

When gas A and gas B are introduced from the aforementioned scavenging ports 18, 19 into the aforementioned combustion chamber 14, the short-circuited gas is made primarily gas B by introducing gas B to the aforementioned combustion chamber 14 in advance of gas A or by introducing gas B to the aforementioned combustion chamber 14 from a position closer than gas A to the exhaust port 16. The amount of the fuel component released to the exhaust system is thereby controlled. In contrast, it has been considered that when gases A and B blend in the combustion chamber 14, the fuel component in gas A is incorporated into the short-circuited gas, and the amount of the fuel component released to the exhaust system increases. In the 2-cycle engine 10 pertaining to the present invention, the pressure Pm is set to 142 kPa or less, the blending of gases A and B in the combustion chamber 14 is thus suppressed, and mixing of the fuel component of gas A into gas B and short-circuiting to the exhaust port 16 is controlled appropriately.

The setting of the maximum value Pm of crankcase 28 pressure P to 142 kPa or less by the 2-cycle engine 10 pertaining to the present invention can be accomplished by a release valve 60 which joins the crankcase 28 to atmospheric space when the crankcase 28 pressure P exceeds 142 kPa. When crankcase 28 pressure reaches 142 kPa or higher, the release valve 60 opens, and the crankcase 28 is joined to atmospheric space, and the maximum value Pm of crankcase 28 pressure is thereby maintained at 142 kPa or lower.

In an alternate embodiment of the present invention, the setting of the maximum value Pm of crankcase 28 pressure P to 142 kPa or less by the 2-cycle engine 10 is accomplished by setting the volume of the crankcase 28. As the volume of the crankcase 28 increases, the maximum value Pm declines. The maximum value Pm can be set to 142 kPa or less by increasing the volume of the crankcase 28 appropriately.

The 2-cycle engine 10 pertaining to the present invention introduces gas A and gas B from the same scavenging ports into the aforementioned combustion chamber 14, and gas B is first and gas A is thereafter introduced from those scavenging ports into the aforementioned combustion chamber 14. The application of a time lag in the introduction of gases A and B from the same scavenging ports 18, 19 into the combustion chamber 14 allows separation of gases A and B from each other and introduction into the combustion chamber 14, and the condition of Pm≦142 kPa maintains good separation of gases A and B in the combustion chamber 14.

The 2-cycle engine 10 pertaining to the present invention is devised such that gas B is introduced from a first pair of scavenging ports 18 into a combustion chamber 14 and gas A is introduced from a second pair of scavenging ports 19 into the combustion chamber 14. The position and orientation of the first pair of scavenging ports 18 and the second pair of scavenging ports 19 are established such that the gas streams introduced from the members of the same pair of scavenging ports into the combustion chamber 14 collide with each other; and the first pair of scavenging ports 18 is established such that it opens to the combustion chamber 14 in advance of the second pair of scavenging ports 19.

It is sufficient if the first pair of scavenging ports 18 introduces gas B is into the combustion chamber 14 in advance of introduction of gas A into the combustion chamber 14 from the second pair of scavenging ports 19, and gas B need not be introduced into the combustion chamber 14 throughout the entire period of the scavenging stroke. In other words, in the latter period of the scavenging stroke in which the ratio of gases short-circuited from the scavenging ports to the exhaust port 16 declines, it is acceptable if, for example, gas A is introduced from the first pair of scavenging ports 18 to the combustion chamber 14, as in the case of the second pair of scavenging ports 19.

Gas B introduced into the combustion chamber 14 first is introduced from the first pair of scavenging ports 18 into the combustion chamber 14 and scavenges burned gases within the combustion chamber 14 from the exhaust port 16. Gas A introduced from the second pair of scavenging ports 19 is introduced into the combustion chamber 14 following gas B. Gas supplied from the scavenging ports to the combustion chamber 14 during the early period of scavenging is easily short-circuited. Thus, the first pair of scavenging ports 18 opens to the combustion chamber 14 in advance of the second pair of scavenging ports 19, and gas B as a gas with a low fuel density is introduced into the combustion chamber 14 in advance of gas A and scavenges the combustion chamber 14 interior. Appropriate scavenging of the combustion chamber 14 interior is thereby performed, the amount of the fuel component within short-circuited gases is reduced, and the amount of hydrocarbons expelled to the exhaust system is reduced. In this 2-cycle engine 10, the condition of maximum Pm≦142 kPa suppresses the mixing of gases A and B in the combustion chamber 14, and mixture of a gas A fuel component into short-circuited gases is very greatly suppressed.

The 2-cycle engine 10 pertaining to the present invention is devised so as to introduce gas B from the first pair of scavenging ports 18 into the combustion chamber 14 and gas A from the second pair of scavenging ports 19 into the combustion chamber 14. The position and orientation of the first pair of scavenging ports 18 and the second pair of scavenging ports 19 are established such that the gas streams introduced from the members of the same pair of scavenging ports into the combustion chamber 14 collide with each other in the combustion chamber 14; and the gas streams from the first pair of scavenging ports 18 towards the combustion chamber 14 are devised so as to be generated closer to the exhaust port 16 than are the gas streams from the second pair of scavenging ports 19 towards the combustion chamber 14.

Streams of gas B introduced from the first pair of scavenging ports 18 to the combustion chamber 14 collide with each other and form a reversing eddy. Streams of gas A introduced from the second pair of scavenging ports 19 to the combustion chamber 14 collide with each other and form a reversing eddy. The streams and reversing eddy of gas B are present in the proximity of the exhaust port 16; thus, flow of the reversing eddy of gas A towards the exhaust port 16, i.e., its conversion to short-circuited gas, is suppressed. In addition, in this 2-cycle engine 10, the condition of maximum Pm≦142 kPa suppresses the blending of gases A and B in the combustion chamber 14, and mixture of a gas A fuel component into short-circuited gases is very greatly suppressed. Finally, in this 2-cycle engine 10, the first pair of scavenging ports 18 may be devised so as to open concurrently to the second pair of scavenging ports 19. This is because even if such concurrent opening is devised, and even if gas A flows from the second pair of scavenging ports 19, the flow of gas B from the first pair of scavenging ports 18 is present proximate to the exhaust port 16, a flow of gas A toward the exhaust port 16 is suppressed, and short-circuited gas comprises primarily gas B.

Examples of embodiments of the invention are next described with reference to the figures. FIG. 1 is a vertical cross-sectional drawing of a Schneurle-type 2-cycle engine 10. In FIG. 1, the piston 33 is nearly at bottom dead center. A Schneurle-type 2-cycle engine 10 is provided in an outdoor trimmer, backpack-type power spreader, or other such device. In the cylinder block 11, a cylindrical space 12 extends inside the cylinder block 11 along the center line of the cylinder block 11 and opens to the lower end face of the cylinder block 11. A top recess 13 is formed on the top surface of the cylindrical space 12 and accommodates the discharge electrode of a spark plug not illustrated. Within the cylindrical space 12, the top recess 13 and the area above the top of the piston 33 form a combustion chamber 14. An intake port 15 and exhaust port 16 are formed along the circumferential wall of the cylinder block 11 such that the exhaust port 16 assumes a slightly higher position than the intake port 15 in the direction of the cylindrical space 12 height at positions separated 180°, and the intake port 15 and exhaust port 16 join the exterior of the cylinder block II with the interior of the cylindrical space 12. At the upper half of the exterior surface of the cylinder block 11, a plurality of cooling fins 17 extend outward in the radial direction of the cylinder block 11, parallel to each other. The first scavenging port 18 and a second scavenging port 19 are formed in positions which open to the combustion chamber 14 as the piston 33 approaches bottom dead center. A cover 24 covers the upper portion of the cylinder block 11 and the cooling fins 17 from the exterior. A is crankcase housing 27 contacts at its upper surface the lower surface of the cylinder block 11 and demarcates to its interior a crankcase 28. The crankcase 28 communicates at all times with the first scavenging port 18 and the second scavenging port 19 and as the piston 33 approaches top dead center also communicates with the intake port 15. A crankshaft 29 is axially supported by both end walls of the crankcase housing 27 in a freely rotating manner, and the piston 33 enters into the cylindrical space 12 in a freely sliding manner and increases and decreases the volume of the combustion chamber 14 by reciprocating motion. A piston pin 36 links the small end of a connecting rod 35 to the piston 33 in a freely rotating manner, and the large end of the connecting rod 35 is linked to a crankshaft 29 crank pin 37 in a freely rotating manner.

A relief valve 60 is disposed externally to the crankcase housing 27, and a pressure escape hole 61 perforates an end wall of the crankcase housing 27. The relief valve 60 is provided with an atmospheric release port 62 and is also connected via a through hole 63 to the pressure escape hole. When the pressure P in the crankcase housing 27 becomes 142 kPa or higher, the relief valve 60 opens, the crankcase 28 is connected to atmospheric space, and the maximum pressure Pm in the crankcase 28 is maintained at 142 kPa or lower. Finally, the point at which the crankcase 28 pressure reaches maximum pressure Pm is immediately before the first scavenging port 18 begins to open to the combustion chamber 14.

A groove 40 is formed at the lower end of the circumferential surface of the piston 33 and extends in a circumferential direction from the exhaust port 16 to the first scavenging port 18. In a predetermined crank arc including top dead center of the piston 33, the ends of the groove 40 are brought into opposition to the exhaust port 16 and the first scavenging port 18 respectively, and the exhaust port 16 and the first scavenging port 18 communicate with each other. A detailed description of the groove 40 is provided in related copending U.S. patent application Ser. No. 09/409, 265, filed on Sep. 30, 1999, and incorporated herein by reference.

Figure 2:
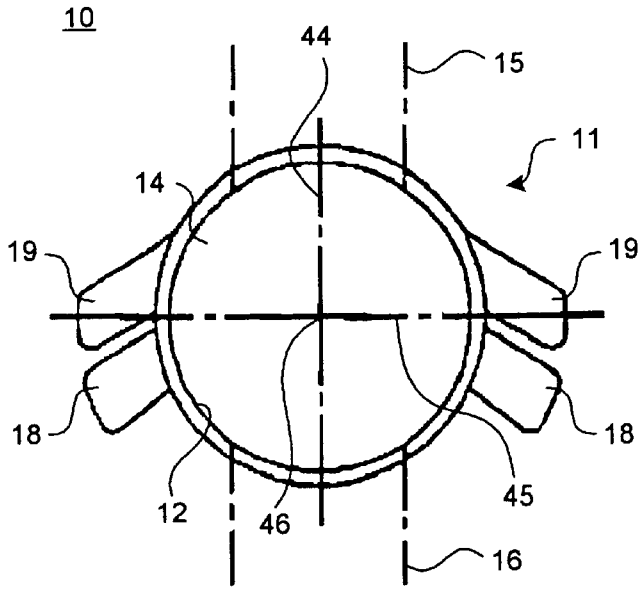
FIG. 2 is a horizontal cross-sectional drawing of a cylinder block along the height of a first scavenging port and a second scavenging port.

FIG. 2 is a horizontal cross-sectional drawing of the cylinder block 11 along the height of the first scavenging port 18 and the second scavenging port 19. In the horizontal cross section of the cylinder block 11, the intake port 15 and exhaust port 16 are positioned opposite to each other with respect to the cross-sectional center 46 of the cylindrical space 12 along the diameters of the circular cross section of the cylindrical space 12, and the intake port 15 and exhaust port 16 are open to the cylindrical space 12. A first diameter 44 is defined as the central line connecting the open center of the intake port 15 and exhaust port 16 along a cross-sectional plane of the cylinder block 11. A second diameter 45 is defined as the diameter passing through the cross-sectional center 46 and perpendicular to the first diameter 44. The first scavenging port 18 and second scavenging port 19 each comprise a pair and are disposed proximate to exhaust port 16 and intake port 15, respectively, with reference to the second diameter 45. The first scavenging port 18 itself and the second scavenging port 19 itself are each symmetric to the first diameter 44, and the first scavenging port 18 and the second scavenging port 19 are each oriented along the direction of the intake port 15.

Figure 3:
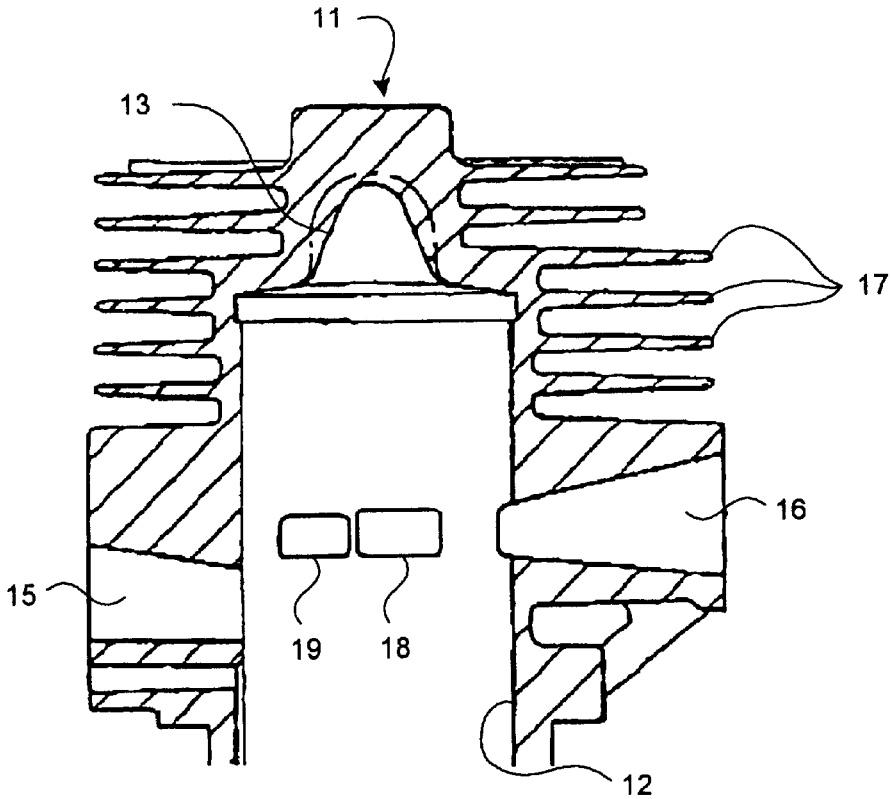
FIG. 3 omits a piston and is a cross-sectional drawing of a cylinder block sectioned in a vertical plane passing through a first diameter in FIG. 2.
Figure 4:
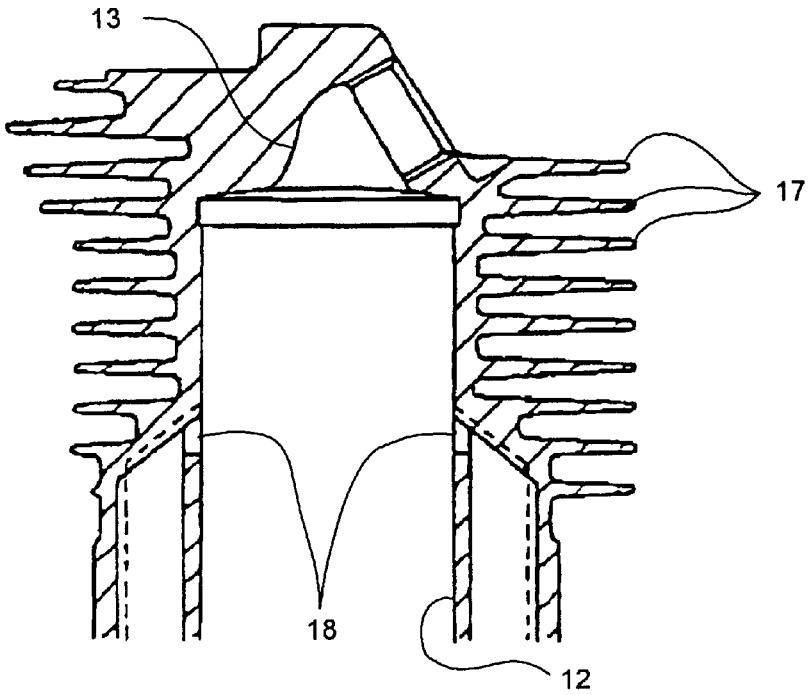
FIG. 4 omits a piston and is a cross-sectional drawing of a cylinder block sectioned in a vertical plane passing through a first scavenging port.

FIG. 3 omits the piston 33 and is a cross-sectional drawing of the cylinder block 11 sectioned in a vertical plane passing through the first diameter 44 in FIG. 2, and FIG. 4 omits the piston 33 and is a cross-sectional drawing of the cylinder block 11 sectioned in a vertical plane passing through the first scavenging port 18. In the first scavenging port 18 and the second scavenging port 19, the opening is in each case an oblong rectangle, and the vertical dimension is larger in the first scavenging port 18 than in the second scavenging port 19. The area of the opening is thus larger in the first scavenging port 18 than in the second scavenging port 19. The heights of the bottom edge of the first scavenging port 18 and the second scavenging port 19 are nearly equal to each other and nearly match that of the lower end of the exhaust port 16, the height of the upper edge of the first scavenging port 18 is slightly higher than that of the second scavenging port 19, and the height of the upper edge of the first scavenging port 18 is slightly lower than the height of the upper end of the exhaust port 16. As FIG. 4 illustrates, the first scavenging port 18 and the second scavenging port 19 are oriented at an incline sloped towards the top of the cylindrical space 12 with respect to the center line running vertically in the cylindrical space 12, and an inflow of gases from the first scavenging port 18 and the second scavenging port 19 to the combustion chamber 14 is oriented towards the top of the cylindrical space 12 in a vertical cross section of the cylindrical space 12.

The function of embodiments of the Schneurle-type 2-cycle engine 10 is next described. Operational phases of the Schneurle-type 2-cycle engine 10 are described below by conversion to the rotational angle of the crankshaft 29, i.e., the crank angle.

In the stroke where the piston 33 transits from bottom dead center towards top dead center, the volume of the combustion chamber 14 decreases, and the volume of the crankcase 28 increases. When the crank angle reaches C1, the piston 33 closes the exhaust port 16, and a fuel-containing gas (fuel-containing gas including fuel and air) is sealed in the combustion chamber 14 and compressed. When the crank angle reaches C2 (C2>C1), the intake port 15 communicates with the crankcase 28, equalizes to the compression of the fuel-containing gas in the combustion chamber 14, and a fuel-air, fuel-containing gas from the carburetor is introduced through the intake port 15 into the crankcase 28.

When the piston 33 approaches top dead center, a spark plug discharge occurs, the fuel in the fuel-containing gas within the combustion chamber 14 is ignited and explodes, and the piston 33 is driven downward. Meanwhile, when the piston 33 is near top dead center, the lower end of the piston 33 reaches the height of the exhaust port 16 and the first scavenging port 18, and the groove 40 joins the exhaust port 16 and the first scavenging port 18 to each other. At such time, the first scavenging port 18 is at the same pressure as the crankcase 28 during the intake stroke and has a low pressure; thus, exhaust gas from the exhaust port 16 travels through the groove 40 and is introduced to the first scavenging port 18, and the first scavenging port 18 is filled with a predetermined quantity.

As the piston 33 crosses top dead center and moves from top dead center towards bottom dead center, the volume of the crankcase 28 decreases, the piston 33 closes the intake port 15, and the crankcase 28 is sealed, and the crankcase 28 pressure (crankcase 28 pressure termed "pressure P" hereinafter) then increases. When pressure P reaches the predetermined value of 142 kPa or higher, the relief valve 60 opens, the interior of the crankcase 28 is thereby joined to the atmospheric release port 62 of the relief valve 60, crankcase 28 pressure is released to the atmosphere, and the maximum value Pm of pressure P is maintained at 142 kPa or lower.

When the crank angle reaches C3 (C3>C2), the exhaust port 16 opens to the combustion chamber 14, and the gas in the combustion chamber 14 whose fuel component has been burned is exhausted from the exhaust port 16 to a muffler (not illustrated) as exhaust gas. When the crank angle reaches C4 (C4>C3), the first scavenging port 18 begin to open to the combustion chamber 14. In conjunction therewith, the exhaust gas filling the first scavenging port 18 is introduced to the combustion chamber 14. Both streams of the exhaust gas moving from the first scavenging port 18 into the combustion chamber 14 are oriented slightly towards the intake port 15 in a horizontal cross section of the cylindrical space 12, flow into the combustion chamber 14, collide with each other atop the first diameter 44, form a reversing eddy, are thereafter oriented towards the exhaust port 16, scavenge the combustion chamber 14, and exhaust the burned gas within the combustion chamber 14 (i.e., the gas generated by burning the fuel component in the fuel-containing gas) from the exhaust port 16. The majority of the exhaust gas introduced to the combustion chamber 14 from the first scavenging port 18 is exhausted from the exhaust port 16 as short-circuited gas together with burned gas. When the crank angle reaches Cs (CS>C4), the second scavenging port 19 begins to open to the combustion chamber 14. Both streams of the fuel-containing gas in the crankcase 28 moving from the second scavenging port 19 into the combustion chamber 14 are then oriented slightly towards the intake port 15 in a horizontal cross section of the cylindrical space 12, flow into the combustion chamber 14, collide with each other nearly atop the first diameter 44, and form a reversing eddy. This reversing eddy of fuel-containing gas contains streams of exhaust gas introduced from the first scavenging port 18 proximate to the exhaust port 16 as well as portions colliding with each other, and movement towards the exhaust port 16 is suppressed; thus, short-circuiting of the fuel component within gas A to the exhaust port 16 is suppressed. In addition, as described previously, the maximum value Pm of crankcase 28 pressure P is at least maintained at approximately 142 kPa or lower, the result of introduction to the combustion chamber 14 from the first scavenging port 18 and the second scavenging port 19 is that blending of gases introduced to the combustion chamber 14 from the first scavenging port 18 and the second scavenging port 19 is suppressed; thus, mixing of the fuel component within gas A into short-circuited gas and exhausting of the same to the exhaust port 16 is suppressed.

Thus, short-circuiting of fuel to the exhaust system is suppressed and hydrocarbons in exhaust are greatly reduced by the facts that (a) the short-circuited gas that scavenges the combustion chamber 14 is a gas with a low fuel density introduced from a first scavenging port 18 that open to the combustion chamber 14 first; (b) the exhaust gas from the first scavenging port 18 generates gas streams and colliding portions closer to an exhaust port 16 than is a fuel-containing gas from a second scavenging port 19, and short-circuiting of a fuel-containing gas comprising a high fuel density gas from the second scavenging port 19 is prevented; and (c) the maximum value Pm of crankcase 28 pressure P is maintained at 142 kPa or lower and thus suppresses blending in the combustion chamber 14 of gases A and B introduced from the first scavenging port 18 and the second scavenging port 19.

Figure 8:
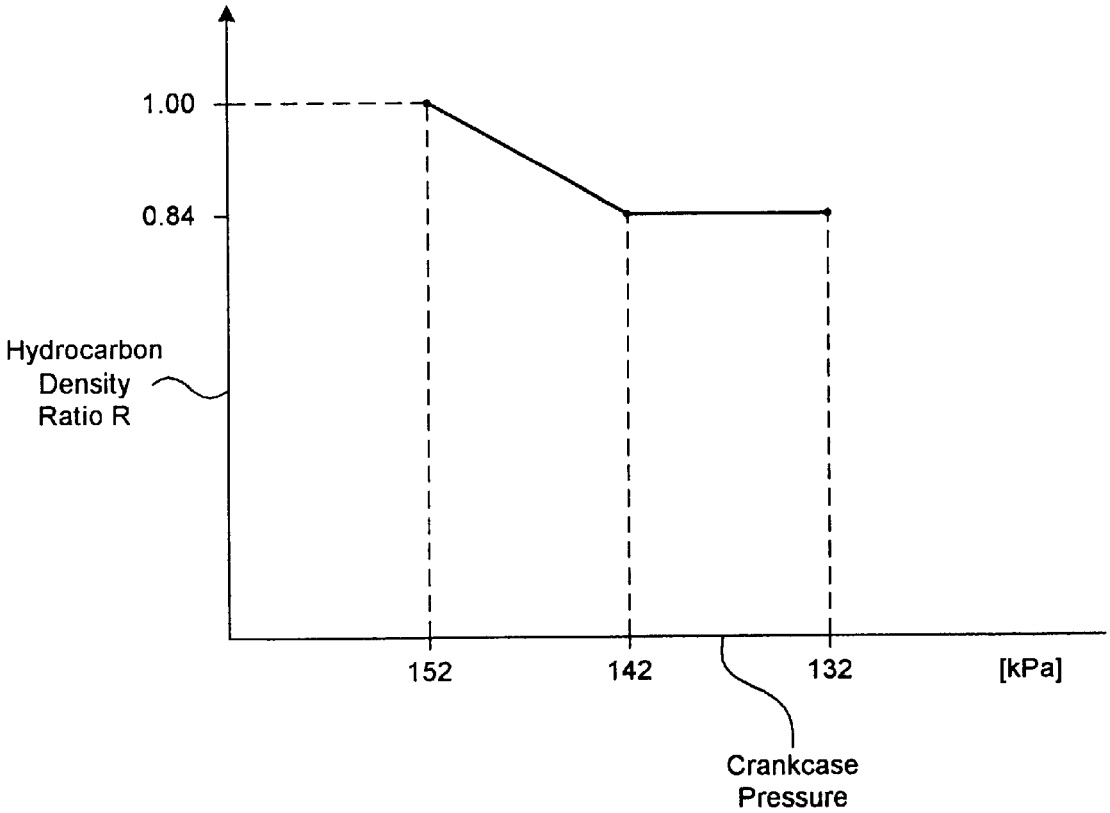
FIG. 8 is a drawing illustrating a reduction of the hydrocarbon content in exhaust gas in a Schneurle-type 2-cycle engine.

FIG. 8 is a drawing illustrating a reduction of the hydrocarbon content in exhaust gas in a Schneurle-type 2-cycle engine 10. The hydrocarbon density ratio R in exhaust gas along the vertical axis is R=D/D1, where D1 is the hydrocarbon density in exhaust gas when Pm=152 kPa and D is the hydrocarbon density in exhaust gas at each maximum crankcase 28 pressure. FIG. 8 shows that as Pm declines from 152 kPa to 142 kPa, the hydrocarbon density ratio R in exhaust gas decreases gradually, and at Pm=142 kPa, the hydrocarbon density in exhaust gas is reduced by approximately 16% (100–84) compared to that when Pm=152 kPa. The figure also shows that in the range of Pm≦142 kPa, the hydrocarbon density ratio R in exhaust gas is nearly constant even with further reduction of Pm. A problem also exists in that as Pm declines, the rate of introduction of fuel-containing gas from the crankcase 28 to the combustion chamber 14 decreases, and at Pm≦142 kPa, there is virtually no increase in the hydrocarbon-reducing effect even when Pm is decreased; thus, the lower limit of Pm is set at 132 kPa. In other words, the pressure at which the relief valve 60 opens with respect to crankcase 28 pressure is set to the predetermined range of 142 kPa–132 kPa, and the crankcase 28 maximum pressure Pm thus becomes 142 kPa≧Pm≧132 kPa.

Figure 5:
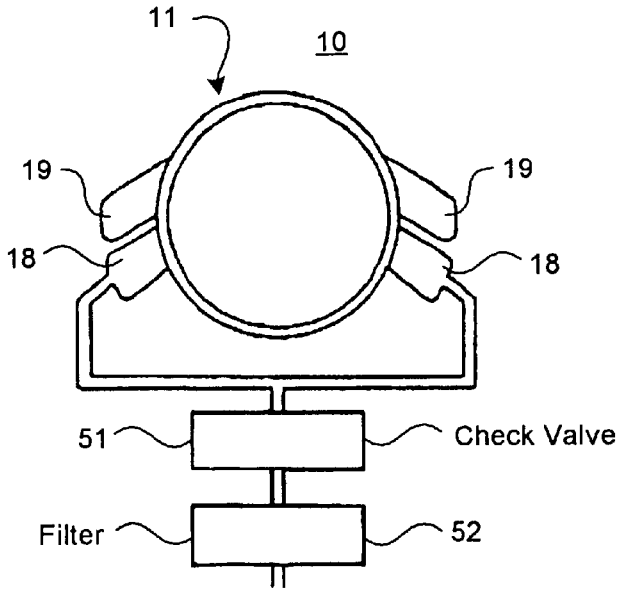
FIG. 5 is a structural drawing of elements in a Schneurle-type 2-cycle engine wherein air is used in lieu of exhaust gas as a gas introduced from a first scavenging port to a combustion chamber.

FIG. 5 is a structural drawing of essential elements in a Schneurle-type 2-cycle engine 10 wherein air is used in lieu of exhaust gas as a gas introduced from a first scavenging port 18 to a combustion chamber 14. A check valve 51 allows the flow of gas in one direction, from atmospheric space representing the exterior of the cylinder block 11 toward the top of a first scavenging port 18, and prevents the flow of gas in the opposite direction. During the intake stroke of the Schneurle-type 2-cycle engine 10, the crankcase 28 experiences negative pressure, and during this negative pressure interval, air from atmospheric space passes through a filter 52 and the check valve 51 and flows into the first scavenging port 18. The quantity of air flowing in toward the first scavenging port 18 is also established as a quantity not impeding the inflow of fuel-containing gas from the intake port 15 to the crankcase 28 as the crankcase 28 approaches positive pressure. As a result, during the next scavenging stroke, air in the first scavenging port 18 is introduced from the first scavenging port 18 to the combustion chamber 14, scavenges the interior of the combustion chamber 14, and becomes short-circuited gas; thus, a fuel component introduced from a second scavenging port 19 into the combustion chamber 14 is prevented from inclusion in the short-circuited gas and direction into the exhaust system in unburned form.

Figure 6:
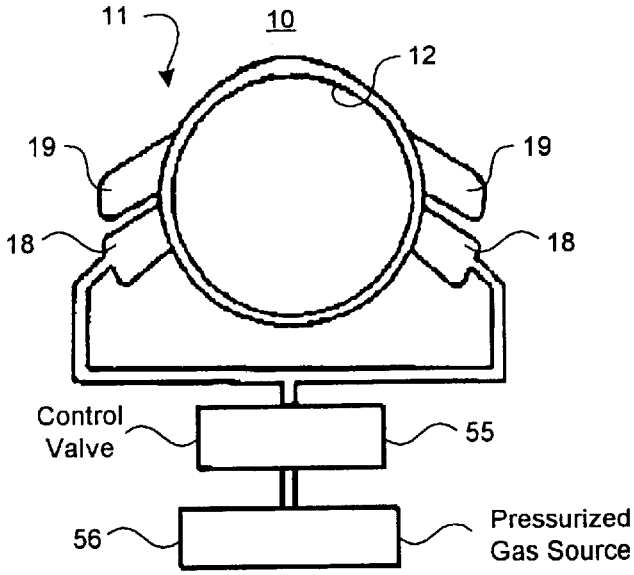
FIG. 6 is a structural drawing of elements in a Schneurle-type 2-cycle engine wherein an inert gas is used as a gas introduced from a first scavenging port to a combustion chamber.

FIG. 6 is a structural drawing of essential elements in a Schneurle-type 2-cycle engine 10 wherein an inert gas is used as a gas introduced from a first scavenging port 18 to a combustion chamber 14. The gas cylinder 56 is filled to a pressurized state with an inert gas such as helium, argon, or neon and communicates via a control valve 55 with the top of a first scavenging port 18. The control valve 55 opens and closes synchronously with a crankshaft 29 and assumes the open position during the late portion of the intake stroke of the Schneurle-type 2-cycle engine 10, and the inert gas within the gas cylinder 56 is directed toward the first scavenging port 18 and fills the first scavenging port 18 with a predetermined quantity. As a result, during the next scavenging stroke, the inert gas in the first scavenging port 18 is introduced from the first scavenging port 18 to the combustion chamber 14, scavenges the interior of the combustion chamber 14, and becomes short-circuited gas; thus, a fuel component introduced from a second scavenging port 19 into the combustion chamber 14 is prevented from inclusion in the short-circuited gas and direction into the exhaust system in unburned form.

In FIG. 6, a gas cylinder 56 filled with an inert gas is used, but an air tank storing pressurized air may also be used in lieu of the gas cylinder 56. Pressurized air may be generated by a fixed pump and used to replenish the air tank as appropriate, thereby obviating exchange of a gas cylinder 56 or refilling of a gas cylinder 56 with a gas.

Figure 7:
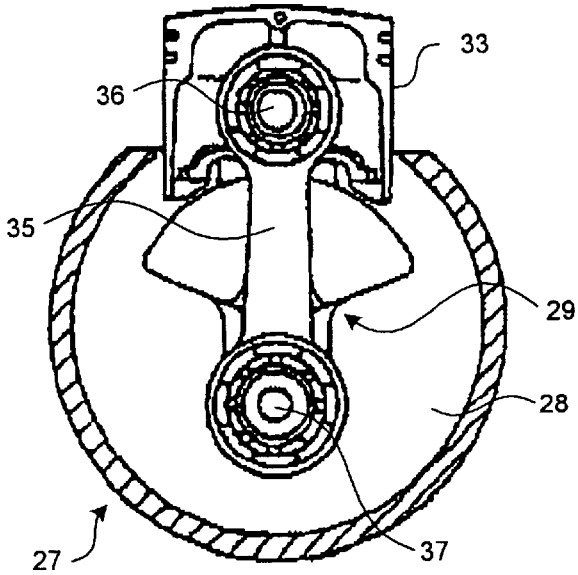
FIG. 7 is a drawing illustrating a structure which controls the maximum pressure of a crankcase in lieu of the relief valve in FIG. 1.

FIG. 7 is a drawing illustrating a structure which controls the maximum pressure of a crankcase 28 in lieu of the relief valve 60 in FIG. 1. The radial dimension of the crankcase housing 27 is enlarged compared to that in FIG. 1, the volume of the crankcase 28 is increased by approximately 150%, and a maximum pressure of 142 kPa$\geqq$Pm$\geqq$132 kPa is effected.

Although specific embodiments of, and examples for, the present invention are described for illustrative purposes, various equivalent modifications can be made without departing from the spirit or scope of the present invention, as will be recognized by those of skill in the relevant art. For example, the teachings provided for lowering hydrocarbons in exhaust gases can be applied not only to the exemplary two-cycle engine system described above, but to other internal combustion engines where reduction of hydrocarbons in exhaust gases would be desirable.

These and other changes can be made to the invention in light of the above detailed description. Therefore, the terms used in the following claims should not be construed to limit the invention to the specific embodiments disclosed, but in general should be construed to include all engines that operate in accordance with the claims to reduce hydrocarbons in the exhaust gases. Accordingly, the invention is not limited by this disclosure, but instead its scope is to be determined entirely by the following claims.

We claim:

1. A two-cycle engine comprising:

a crankcase having a crank chamber, the crankcase being pressurizable during operation of the two-cycle engine;

a fuel intake port in communication with the crankcase, the fuel intake port being configured to provide a fuel mixture having a first fuel mass concentration to the crankcase;

a cylinder having a combustion chamber with an upper end portion, the cylinder being coupled to the crankcase;

an exhaust port in the cylinder;

a first transfer port in communication with the crankcase and the cylinder, the first transfer port having a first opening into the cylinder, the first opening having a first upper edge;

a second transfer port in communication with the crankcase and the cylinder, the second transfer port having a second opening into the cylinder, the second opening having a second upper edge, the second upper edge of the second opening being further away from the upper end portion of the combustion chamber than the first upper edge of the first opening;

a piston reciprocally moveable in the cylinder and positionable to open or close the first and second openings and the exhaust port as the piston reciprocates in the cylinder;

a passage in communication with the first transfer port, the passage being configured to introduce a selected gas having a second fuel mass concentration into the first transfer port; and a pressure relief valve in communication with the crankcase for controlling the pressure in the crankcase during operation of the two-cycle engine.

2. The two-cycle engine of claim 1 wherein the pressure relief valve is a one-way check valve.

3. The two-cycle engine of claim 1 wherein the pressure relief valve is moveable to an open position to control the pressure in the crankcase when the pressure in the crankcase is in the range of at least approximately 132 kPa to 142 kPa, inclusive.

4. The two-cycle engine of claim 1 wherein the pressure relief valve is moveable to an open position to limit the maximum pressure in the crankcase to at least approximately 142 kPa or less.

5. The two-cycle engine of claim 1 wherein the pressure relief valve is moveable to an open position to limit the maximum pressure in the crankcase to between 132 kPa and 142 kPa, inclusive.

6. The two-cycle engine of claim 1 wherein the second fuel mass concentration of the selected gas is smaller than the first fuel mass concentration of the fuel mixture.

7. The two-cycle engine of claim 1 wherein the first opening of the first transfer port is closer to the exhaust port than the second opening of the second transfer port.

8. The two-cycle engine of claim 1 wherein the first opening of the first transfer port is larger than the second opening of the second transfer port.

9. The two-cycle engine of claim 1 wherein the first opening of the first transfer port defines a first length dimension and the second opening of the second transfer port defines a second length dimension, and wherein the first length dimension is greater than the second length dimension.

10. The two-cycle engine of claim 1 wherein the first opening of the first transfer port has a first bottom edge and the second opening of the second transfer port has a second bottom edge, and wherein the first bottom edge is at least approximately the same distance from the upper end portion of the combustion chamber as the second bottom edge.

11. The two-cycle engine of claim 1 further comprising:

a third transfer port in communication with the crankcase and the cylinder, the third transfer port having a third opening into the cylinder, the third opening having a third upper edge at least approximately the same distance from the upper end portion of the combustion chamber as the first upper edge of the first opening; and a fourth transfer port in communication with the crankcase and the cylinder, the fourth transfer port having a fourth opening into the cylinder, the fourth opening having a fourth upper edge at least approximately the same distance from the upper end portion of the combustion chamber as the second upper edge of the second opening.

12. The two-cycle engine of claim 11 wherein the third opening of the third transfer port is closer to the exhaust port than the second opening of the second transfer port and the fourth opening of the fourth transfer port.

13. The two-cycle engine of claim 11 wherein:

the first and third transfer ports are angled so that a first gas introduced into the cylinder through the first transfer port opening collides with a third gas introduced into the cylinder through the third transfer port opening; and the second and fourth transfer ports are angled so that a second gas introduced into the cylinder through the second transfer port opening collides with a fourth gas introduced into the cylinder through the fourth transfer port opening.

14. The two-cycle engine of claim 13 wherein:

the first and third transfer ports are angled to provide a first back eddy; and the second and fourth transfer ports are angled to provide a second back eddy, the first back eddy being closer to the exhaust port than the second back eddy.

15. The two-cycle engine of claim 1 wherein the cylinder has an inner wall and the piston has an outer surface, and wherein the passage comprises a groove with an open cross-section formed in the piston's outer surface and open along its length toward the inner wall of the cylinder.

16. The two-cycle engine of claim 15 wherein the groove has a U-shaped open cross-section.

17. The two-cycle engine of claim 15 wherein the groove extends at least generally circumferentially from the exhaust port to the first transfer port when the piston is in a pre-selected stroke position.

18. The two-cycle engine of claim 15 wherein the groove is configured for communication between the exhaust port and the first transfer port when the piston is in a top dead center piston position.

19. The two-cycle engine of claim 15 wherein the open cross-section of the groove is closed off along its entire length by the inner wall of the cylinder when the piston is in a position intermediate of a top dead center and bottom dead center position.

20. The two-cycle engine of claim 1 further comprising a valve coupled to the passage and moveable to an open position to introduce the selected gas into the first transfer port.

21. The two-cycle engine of claim 20 wherein the selected gas is outside air.

22. The two-cycle engine of claim 20 wherein the two-cycle engine is connectable to a pressurized inert gas source, and wherein the selected gas is inert gas supplied from the pressurized gas source.

23. A method for reducing hydrocarbons in exhaust gas from a two-cycle engine, the two-cycle engine having a pressurizable crankcase, an intake port in communication with the crankcase, a cylinder having a combustion chamber, the cylinder being coupled to the crankcase, a first transfer port in communication with the crankcase and the cylinder, the first transfer port having a first opening into the cylinder, a second transfer port in communication with the crankcase and the cylinder, the second transfer port having a second opening into the cylinder, and a piston reciprocally moveable in the cylinder and positionable to open or close the first and second openings and pressurize the crankcase as the piston reciprocates in the cylinder, the method comprising:

moving the piston away from the combustion chamber along a down-stroke;

controlling the pressure in the crankcase as the piston moves away from the combustion chamber along the down-stroke;

introducing a first gas having a first fuel mass concentration into the cylinder through the first opening as the piston moves away from the combustion chamber along the down-stroke, and after introducing the first gas into the cylinder, introducing a second gas having a second fuel mass concentration into the cylinder through the second opening as the piston moves away from the combustion chamber along the down-stroke, the second fuel mass concentration of the second gas being greater than the first fuel mass concentration of the first gas.

24. The method of claim 23 wherein the two-cycle engine further comprises a pressure relief valve in communication with the crankcase, and wherein controlling the pressure in the crankcase comprises controlling the pressure with the pressure relief valve.

25. The method of claim 23 wherein controlling the pressure in the crankcase comprises limiting the maximum pressure in the crankcase to at least approximately 142 kPa or less.

26. The method of claim 23 wherein controlling the pressure in the crankcase comprises limiting the maximum pressure in the crankcase to between 132 kPa and 142 kPa, inclusive.

27. The method of claim 23 wherein the two-cycle engine has an exhaust port in the cylinder, and wherein:

introducing the first gas into the cylinder comprises introducing the first gas into the cylinder through the first opening at a first location; and introducing the second gas into the cylinder comprises introducing the second gas into the cylinder through the second opening at a second location further from the exhaust port than the first location.

28. The method of claim 23 wherein the two-cycle engine has an exhaust port in the cylinder configured to expel an exhaust gas, and wherein introducing the first gas into the cylinder comprises introducing a portion of the exhaust gas into the cylinder.

29. The method of claim 23 wherein introducing the first gas into the cylinder comprises introducing outside air into the cylinder.

30. The method of claim 23 wherein the two-cycle engine is connectable to a pressurized gas source, and wherein introducing the first gas into the cylinder comprises introducing an inert gas from the pressurized gas source into the cylinder.

* * * * *